US005452265A

United States Patent [19]

Corsaro

[11] Patent Number: 5,452,265

[45] Date of Patent: Sep. 19, 1995

[54] ACTIVE ACOUSTIC IMPEDANCE MODIFICATION ARRANGEMENT FOR CONTROLLING SOUND INTERACTION

[75] Inventor: Robert D. Corsaro, Upper Marlboro, Md.

[73] Assignee: The United States of America as represented by the Secretary of the Navy, Washington, D.C.

[21] Appl. No.: 733,415

[22] Filed: Jul. 1, 1991

[51] Int. Cl.[6] ..... H04R 17/00

[52] U.S. Cl. ..... 367/152

[58] Field of Search ..... 367/1, 135, 152, 900, 367/901; 181/400, 402; 310/334, 335, 336

[56] References Cited

U.S. PATENT DOCUMENTS

| | | | |
|---|---|---|---|
| 2,000,806 | 7/1932 | White | 181/30 |
| 3,309,704 | 9/1965 | Klinger | 343/18 |
| 3,515,910 | 11/1968 | Fritz et al. | 310/8 |
| 3,826,870 | 3/1970 | Wurm et al. | 179/1 P |
| 3,894,169 | 7/1973 | Miller | 428/425 |
| 4,016,530 | 4/1977 | Goll | 367/157 |
| 4,025,724 | 5/1977 | Davidson, Jr. et al. | 367/901 |
| 4,117,485 | 1/1981 | Gorr et al. | 343/18 A |
| 4,152,474 | 2/1981 | Cook | 428/137 |
| 4,346,782 | 8/1982 | Böhm | 181/207 |
| 4,352,039 | 9/1982 | Hagood et al. | 310/328 |
| 4,390,976 | 1/1983 | Eynck | 367/153 |
| 4,628,490 | 12/1985 | Kramer et al. | 367/1 |
| 4,828,932 | 7/1987 | Morimoto et al. | 428/608 |
| 4,835,747 | 5/1989 | Billet | 367/164 |
| 4,883,143 | 10/1988 | Laiger | 181/286 |
| 4,928,264 | 5/1990 | Kahn | 367/901 |

OTHER PUBLICATIONS

Washington Post, May 13, 1990, p. C 3.

Abstract of F. D. Shields et al., "Smart Acoustically Active Surfaces", J. Acous. Soc. Am. Supp. 1, vol. 85 (Spring 1989) p. S62.

Abstract of R. Howarth et al., "Large Area Sensors for Active Acoustic Control Systems," J. Acous. Soc. Am., vol. 85, supp 1 (Spring '89).

T. R. Howarth et al., "Coating for an Underwater Active Acoustic Attenuation Control System," Colloque de Physique, vol. 51, p. C2-801 (Feb. 1990).

T. R. Howarth et al., "Sensor Design for an Active Underwater Acoustic Attenuation Control System Coating," vol. 4, p. 83 (Penn. State University, 1989). (J. of Wave Material Interaction.).

X.-Q. Bao et al., "Model of a Bilaminar Actuator for Active Acoustic Control systems," J. Acous. Soc. Am., vol. 87, p. 1350 (Mar., 1990).

V. V. Varadan et al., "Composite Smart Skins for Airborne Structures," SPIE vol. 1307 Electro-Optical Materials for Switches, Coatings, Sensor Optics and Detectors, p. 232 (1990).

P. S. Dubbleday et al., "Algorithm-Based Method for Suppressing the Transmission of Sound in a Water--Filled Waveguide," J. of Intell. Mater. Syst. and Structures, vol. 2, p. 129 (Apr., 1991).

T. R. Howarth et al., "Piezocomposite Coating for Active Underwater Sound Reduction," J. Acoust. Soc. Am., vol. 91, p. 823 (Feb. 1992).

(List continued on next page.)

*Primary Examiner*—Ian J. Lobo

*Attorney, Agent, or Firm*—Thomas E. McDonnell; Edward F. Miles

[57] ABSTRACT

An active impedance modification device or arrangement enables the interaction of sound with a structural surface to be controlled, e.g., so that, reflections from that surface (which can be the hull of a submarine) are substantially reduced or eliminated. The device comprises a coating comprising an inner driver transducer layer in contact with the structural surface an outer receiver transducer layer which receives the sound, in combination with a variable gain, variable phase shift amplifier connected between the interface of the outer layer with the sound carrying medium (e.g., water) and the interface between the second layer and the structural surface. Reflections are reduced by setting the gain and phase shift of the amplifier to simulate the input impedance of the sound carrying medium.

2 Claims, 2 Drawing Sheets

OTHER PUBLICATIONS

L. D. Lafleur et al., "Acoustically Active Surfaces Using Piezorubber," J. Acoust. Soc. Am., vol. 90, p. 1230 (Sep. 1991).

Abstract of paper, T. R. Howarth et al., "Piezocomposite Actuator Designs for an Active Underwater Acoustic Control System Coating," Abstract book fo 119th Meeting: Acoustical Soc. Am., p. S 17, May 1991.

Abstract of paper, V. V. Varadan et al., "Active Underwater Acoustic Damping Coating," Abstract book, 119th Meeting: Acoustical Soc. Am. (May, 1990), p. S 146.

Abstract of paper T. R. Howarth et al., "Composite Smart Skin Systems," 120th Meeting: Acoustical Society of America, p. S115, (Nov., 1990).

Abstract of paper, T. R. Howarth et al, "Digital Time Delay Network for Active Underwater Acoustic Coating," 121st Meeting: Acoustical Society of America, p. 1915 (Apr.–May, 1991).

ACTIVE ACOUSTIC IMPEDANCE MODIFICATION ARRANGEMENT FOR CONTROLLING SOUND INTERACTION

FIELD OF THE INVENTION

The present invention relates to an active arrangement or device controlling the interaction of sound with a structural surface, such as the hull of a submarine, the housing surfaces of acoustic inspection tanks or the walls of a room in a building or a test chamber.

BACKGROUND OF THE INVENTION

A common characteristic of coverings, coatings or other treatments used in reducing or otherwise modifying the reflection-transmission characteristics of surfaces is that these approaches are all passive.

In this regard, such techniques rely on the use of materials which have the appropriate mechanical properties and which are geometrically configured to produce the performance or result desired. To cite a simple example, materials that provide high sound absorption can be used to absorb incoming sound and thus reduce reflections. Similarly, special geometric configurations have been provided which spatially diffract or diffuse the reflected energy. In other applications, highly reflective surface coatings, such as decoupling coatings, are used to prevent sound from crossing a surface.

All such broad band passive coatings or coverings require that the coating or covering material be of a reasonably substantial thickness. Typically the coating thickness must be greater than one-fifth of the wavelength of the lowest frequency of the sound involved. At frequencies greater than about 10 kHz in water (and about 2 kHz in air), this thickness limitation is not a serious consideration because the corresponding material thickness is less than a few centimeters. However, at much lower frequencies, the thickness required can be prohibitive in many applications (e.g., a thickness of 30 cm is required at 1 Khz in water and 200 Hz in air).

Prior art coatings and other devices for absorbing or otherwise modifying acoustic waves include those disclosed in U.S. Pat. Nos. 4,883,143 (Lagier); 4,390,976 (Eynck); 2,000,806 (White); 3,515,910 (Fritz); 4,828,932 (Morimoto et al.); 4,628,490 (Kramer et al.); 4,152,474 (Cook, deceased et al.); and 4,346,782 (Bohm). Briefly considering these patents, the Lagier patent discloses an anechoic coating for preventing the reflection of acoustic waves which includes a first elastic layer of low compressibility and high absorbency and a second layer of high compressibility. A set of plates covers the second layer and rods fixed to the plates transmit vibrations to the first layer. The Eynck patent discloses an underwater acoustic signal conditioning device including a skirt baffle positioned adjacent to a hull surface, an acoustic conditioning module comprising inner and outer spaced cover plates and "tuned" damping elements secured thereto, and an outer layer containing a plurality of hydroplanes. The White patent discloses an apparatus for sound modification wherein sound waves are split into various components and the components are recombined in a different phase relationship. The Fritz et al. patent discloses an acoustic energy absorbing material for absorbing sound energy under water wherein particles of piezoelectric or ferroelectric material convert incident sound wave energy into electrical energy that is dissipated in a conductive coating. The Morimoto et al. patent discloses a porous sound absorbing metallic material comprising a laminate of expanded metal and metal fiber. The Kramer et al. patent discloses a wideband sonar energy absorber comprising a non-conductive elastometer matrix having piezoelectric or magnetstrictive particles disposed therein. The Cook patent discloses an acoustic absorber comprising an organic polymer coating on a substrate which covers the substrate and partially fills openings therein. The Bohm patent discloses a sound absorbing coating comprising two layers of viscoelastic material wherein the modulus of elasticity of the outer layer is substantially greater than that of the inner layer.

These passive coatings all hare the common defect that, to be effective, they must be thick compared to expected acoustic wavelengths. This places a practical limit on their usefulness at lower frequencies.

SUMMARY OF THE INVENTION

Accordingly, an object of the invention is to permit the acoustic dampening of a surface by a means which does not depend solely on absorption and which can be physically small compared to expected acoustic wavelengths.

In accordance with the invention, an active assembly or arrangement is provided for controlling the interaction of sound with the surface of a structure wherein the acoustic impedance of that surface can be actively controlled and can be set as desired to provide a selected response to the incoming sound. More particularly, the acoustic impedance can be varied so as to permit the user to modify or select the desired reflection and transmission characteristics of the surface, so that, e.g., in an underwater application, a submarine hull can be made to be substantially non-reflective to sound. As will be appreciated, the provision of such an anechoic behavior is desirable in many different settings and the invention can be used in applications ranging from acoustic inspection tanks (to provide acoustically invisible walls) to, as noted above, submarines (to prevent location of the submarine using active SONAR techniques). The invention can also be used in constructing rooms or test chambers having walls of variable reflectivity or transmissibility.

According to the invention, a device or assembly is provided for controlling or modifying the interaction of sound waves with a structural surface, the device or assembly comprising first (inner) and second (outer) transducer layers which are disposed on the structural surface on which sound waves are received and which convert the pressure exerted thereon into corresponding electrical signals, and an electronic control circuit, connected between the two layers, for applying an electrical signal produced by one layer in response to a sound pressure wave to the other layer so as to produce a composite signal in the other layer based on that electrical signal and the electrical signal produced by the other layer in response to the sound pressure wave.

In one specific preferred embodiment used in controlling the reflection characteristics of the structural surface, the input of the circuit is connected to the outer surface of the outer (second) layer, i.e., at the interface between the sound carrying medium (e.g., water or another fluid) and the outer layer, and the output of the amplifier circuit is connected to the interface between the inner (first) layer and the structural surface.

The circuit preferably comprises a variable gain and variable phase shift to impedance match the fluid and the surface so that reflection of sound waves by the structure is reduced. In a further advantageous embodiment, the gain and phase shift of the amplifier is set so as to simulate the acoustic input impedance of a free surface so that the sound reflected from the structural surface is shifted in phase by approximately 180° as compared with a structural surface without the invention. As discussed below, other reflection and transmission characteristics can also be provided.

Considering some of the most important advantages of the invention, the coating provided by the two layers can be made to be very much thinner than is possible with prior art arrangements and thus the invention is particularly useful at low frequencies where, as discussed above, the required thickness of conventional passive coatings is so great as to preclude the practical use of the coatings. Further, the adjustable nature of the impedance control provided, i.e., the ability to provide remote adjustment of the amplifier gain and phase shift, enables environmental and operational changes to be accommodated. In addition, the performance of the coating of the invention is broad band and is inherently insensitive to temperature and pressure.

Other features and advantages of the invention will be set forth in, or apparent from, the following detailed description of preferred embodiments of the invention.

DESCRIPTION OF THE PREFERRED EMBODIMENTS

Figure 1:
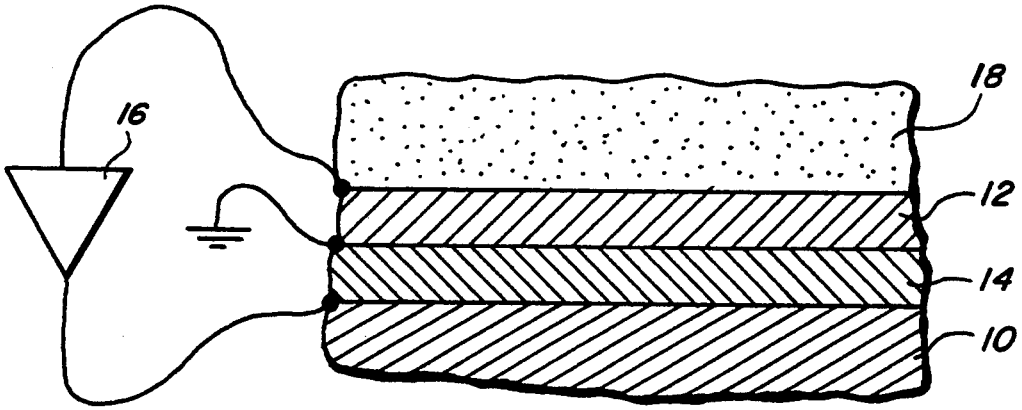
FIG. 1 is a schematic cross-sectional view of a structure incorporating the active impedance modification device or arrangement of the invention.

Referring to FIG. 1, a schematic representation is provided of a structure incorporating an active impedance modification arrangement in accordance with the invention. More particularly, a steel backing, which is indicated 10 and can, e.g., be part of the hull of a submarine, has provided thereon first and second transducer layers 12 and 14 which are connected together through a high gain electrical amplifier 16. The interface between the layers 12 and 14 is preferably grounded as illustrated to phase center the responses of members 12 and 14. The entire structure is submerged within a fluid 18 which can, e.g., be water or air.

Incoming sound waves are received by the first receiver transducer layer 12, or more simply receiver 12, and the resultant electrical signal produced by transducer layer 12 in response to such a sound wave is amplified by feedback control amplifier system 16. The latter provides both amplification and phase shifting of the signal and the resultant electrical output signal produced thereby is applied to the second transducer layer 14, called the driver, at the interface of that layer with backing 10. The input impedance of the assembly formed by transducer layers 12 and 14 and steel backing 10 is therefore a function of the electrical parameters of the "feedback" loop provided by amplifier 16. By adjusting the gain and phase shift provided by the feedback loop a wide variety of acoustic impedance conditions can be provided, even for extreme boundary conditions (such as rigid, free and water-like boundary conditions). These acoustic conditions include, e.g., total reflection, total inverted reflection, and no reflection.

Receiver 12 can be any transducer known to workers in acoustics, for example one of the well known PZT piezoelectrics, (PZT indicates a transducer made of lead zirconium titanate), but is preferably of PVDF (polyvinylidene fluoride), which is a flexible, easily worked, material having an acoustic impedance well matched to water.

Driver 14 can be any appropriate acoustic transducer, such as the well known "piezoelectric rubbers," which have piezoelectric material mounted within a flexible matrix, e.g. in ground or rod form within a flexible matrix.

The thickness of members 12, 14 should be sufficiently, small to prevent acoustic resonances in the transducer 12, 14, thus members 12 and 14 should both be small compared to any expected acoustic wavelength, and preferably much less than one quarter of such a wavelength to prevent quarter wave reflections from arising.

The width of members 12, 14 (i.e. in the direction parallel to plate 10) is not critical to the operation of the transducer, and is determined by other design consideration specific to particular applications, most notably the particular look angles and acoustic frequencies that the designer wishes the transducer to be sensitive.

Figure 2:
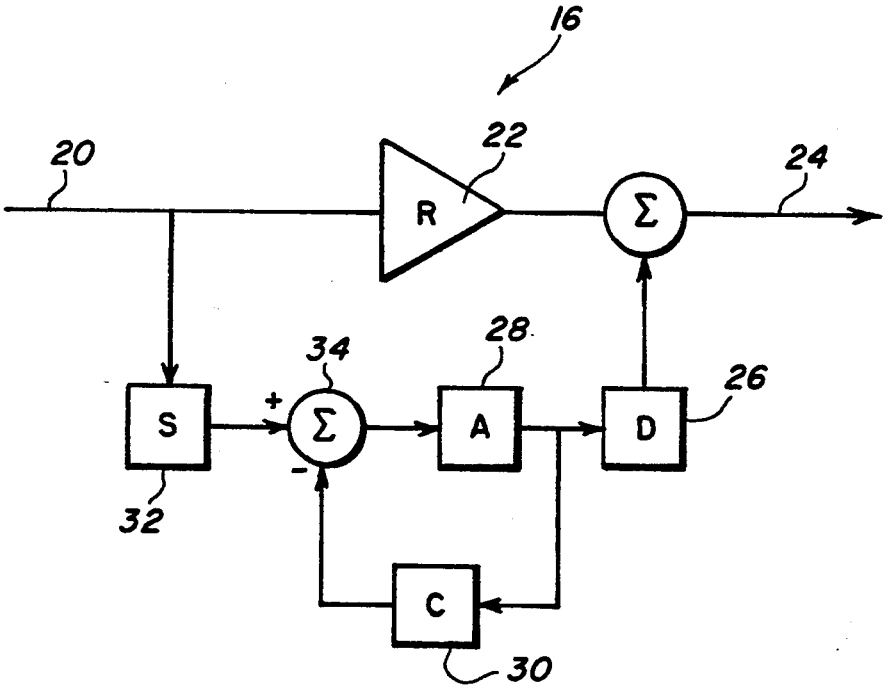
FIG. 2 is a block diagram illustrating the implementation of the control circuit.

FIG. 2 illustrates how one can determine the particulars of feedback control amplifier 16, taken from standard control systems analysis. FIG. 2 is a simple feed forward circuit, in which an acoustic input at 20 is reflected by the target (via the far field target scattering transfer function R) and detected by the receiver 12 and is summed with a feed forward loop 32, 28, 26 and 30, having transfer functions S, A, D, and C respectively, of which S is the transfer function of the receiver relative to a far field source, and D is the transfer function of the driver in the far field, C is a negative feedback corresponding to the coupling between receiver 12 and driver 14, and A is a controllable gain. Cancellation occurs when the signal in the feedforward loop equals the signal through member 22. From elementary control theory, the value of A which causes this is:

$$A=(1/C)[1/(1-SD/RC)]$$

One can measure C, S, D, and R, and then calculate the complex gain of A necessary for cancellation. This is referred to as the calibration approach.

If the system can be approximated by a one-dimensional model, then one can ignore the term SD/RC in the above equation, which reduces to:

$$A=1/C=1/sd$$

Where s is the free-field sensitivity of the receiver 12, and d is the efficiency of the driver 14 on a rigid backing. In practical use, this one dimensional approach of is believed most advantageous. It is very simple, and in order to implement it one need only the knowledge of s and d, which are easily measured in the laboratory. The full calibration approach besides being more complex, requires knowledge of D, S, R, and C, which, being dependent on far field radiation patterns, are not always available or well-known.

Figures 3A, 3B, 3C:
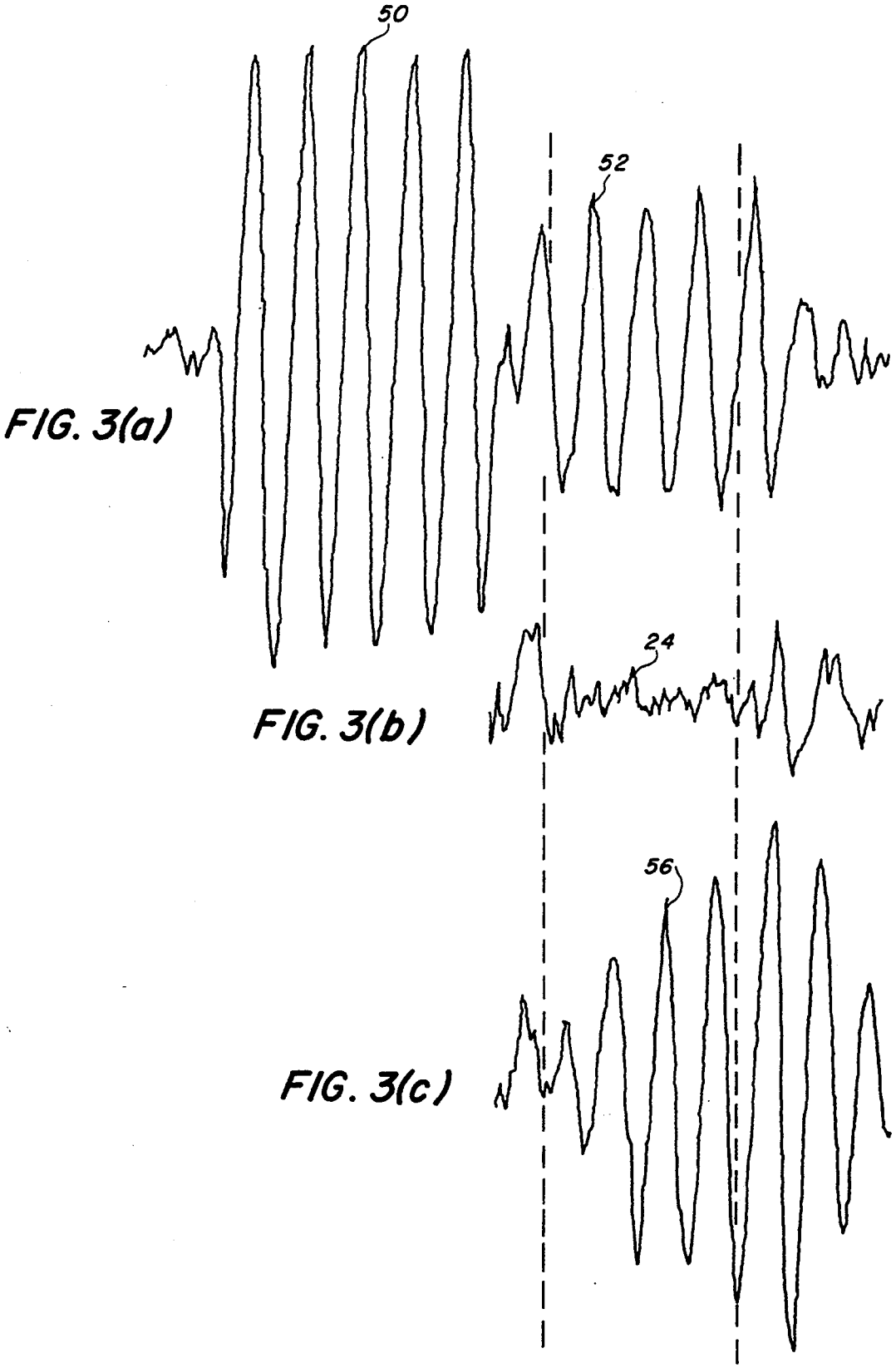
FIGS. 3(*a*) to 3(*c*) are sound waveforms or signals used in explanation of different modes of operation of the invention.

Referring to FIGS. 3(*a*) to 3(*c*), the signal waveforms associated with some of the conditions that can be provided with the arrangement of invention are illustrated. The signal denoted 50 in FIG. 3(*a*) is that generated in water by a remote source while signal 52 is that reflected from the structure formed by layers 12, 14 and backing 10 when the feedback controller 16 is switched off, i.e., open circuited. Thus, signal 52 is basically representative of the reflectivity of the uncoated rigid backing 10, i.e., that of a conventional backing unmodified by the invention.

Referring to FIG. 3(*b*), signal 24 is representative of the reflection produced when the gain and phase shift provided by controller 16 are set so as to simulate the input impedance of water. It will be noted that the reflected signal is greatly reduced (by more 20 db) and essentially all that remains are the transients at the leading and trailing edges of the pulse envelope. It is pointed out that these transients are artifacts of the use of a narrow band amplifier in the testing under consideration, can be substantially eliminated with the use of a different amplifier and are of no real significance in any event.

Referring to FIG. 3(*c*), signal 56 is representative of the reflection produced when the feedback controller 16 is adjusted so as to simulate the input impedance of a free surface. It is to be noted that the reflected signal is similar to signal 52 of FIG. 3(*a*) but with the 180° phase shift that would be expected from a free-surface reflection.

The waveforms of FIGS. 3(*a*)–3(*c*) were generated in the laboratory, using an embodiment of the invention comprised of a standard model F27 driver from the Navy's Underwater Sound Reference Division, and a PVDF receiver layer. The embodiment was driven by an acoustic signal of about 25 kHz.

An important consideration in the operation of the assembly described above is the small separation distance between the first, receiver layer 12 and the second, driver layer 14. Ideally, the two layers 12 and 14 should be in contact to ensure good coupling between the two. For example, in the situation discussed above wherein free surface conditions are simulated (FIG. 3(*c*)), it will be appreciated that the signal from the receiver layer 12 is in the nature of a error signal, i.e., any pressure sensed by the receiver layer 12 causes the driver layer 14 to move precisely in such a manner as to relieve the pressure on the receiver layer. In other cases, the output of the receiver layer 12 will be a combination of source and error components (which can be predicted using a simple mathematical model). It will be appreciated that any substantial reflection between the receiver and driver layers 12 and 14 will introduce time delays, and inherent phase shifts, and such delays complicate both the analysis necessary and the instrumentation required, and also degrade the degree of control available.

Among other advantages of the invention, the thickness of the coating comprised by layers 12 and 14 can, as discussed above, be made to be much thinner than is possible with prior art approaches to the problem. In this regard, the coating thickness required is basically a function of the receiver sensitivity desired and the driver-displacement needed. For many practical applications, this thickness is very much smaller than the acoustic wavelength and hence the invention is of special importance at low frequencies at which, as noted above, the thickness of conventional passive coatings is prohibitive in many applications.

In addition, the invention permits simple remote adjustment of the acoustic input impedance, and thus, this impedance can be varied, as desired by the user, to adjust for environmental or operational changes.

A further advantage is that the operation of coating of the invention can be broad band since the bandwidth is controlled largely by the electrical parameters associated with the feedback amplifier 16.

In addition, the performance of the invention is inherently insensitive to temperature and pressure. This contrasts with the performance of most passive coatings which typically operate effectively only over a narrow temperature and pressure range.

It should be understood that although the invention has been described above the connection with sound waves in water, it is applicable to any fluid including air. Further, although the invention is seen to be of primary importance in modifying reflections, the coating arrangement of the invention can also be used to modify sound radiation, i.e., sound radiated form backing structure 10. In addition, an array of individual coating arrangements or assemblies can be used to shape, or form into a beam, a reflected or transmitted acoustic signal. The output signal of the electrical amplifier 16 provides a convenient amplified composite signal related, in a well defined manner, to the acoustic signal present in the fluid and thus can serve as an input to an acoustic detection system. Further, the invention is also applicable to solid, i.e., non-fluid, structures, such as different parts of machines for an isolating machine vibrations.

Although the invention has been described relative to exemplary embodiments thereof, it will be understood by those skilled in the art that variations and modifications can be effected in these exemplary embodiments without departing from the scope and spirit of the invention.

What is claimed is:

1. A device for matching the acoustic impedance between a fluid and a surface, said device comprising:

a receiver for receiving an acoustic signal from said fluid and transducing said acoustic signal into an electrical signal;

a driver acoustically coupled to said receiver and disposed on said surface;

an electronic amplifier means for producing an electrical feedback signal to drive said driver, said feedback signal being said electrical signal with a preselected amplitude gain and preselected phase shift;

wherein said preselected gain and said preselected phase shift, together constitute a complex gain A, said A being substantially given by:

$$A=(1/C)[1/(1-SD/RC)]$$

wherein said R is the transfer function of the far-field scattering function of said device, S is the transfer function of said receiver relative to the far-field, D is the transfer function of said driver in the far-field, and C is the transfer function of the coupling between said receiver and driver.

2. A device for matching the acoustic impedance between a fluid and a surface, said device comprising:

a receiver for receiving an acoustic signal from said fluid and transducing said acoustic signal into an electrical signal;

a driver acoustically coupled to said receiver and disposed on said surface;

an electronic amplifier means for producing an electrical feedback signal to drive said driver, said feedback signal being said electrical signal with a preselected amplitude gain and preselected phase shift;

wherein said preselected gain and said preselected phase shift together constitute a complex gain A, said A being substantially given by:

$$A=1/sd$$

wherein said s is the free-field sensitivity of said receiver, and said d is the efficiency of said driver on a rigid backing.

* * * * *